US007730975B2

(12) United States Patent
Hall et al.

(10) Patent No.: US 7,730,975 B2
(45) Date of Patent: Jun. 8, 2010

(54) DRILL BIT PORTING SYSTEM

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 96 days.

(21) Appl. No.: 12/178,467

(22) Filed: Jul. 23, 2008

(65) Prior Publication Data

US 2008/0302572 A1 Dec. 11, 2008

Related U.S. Application Data

(63) Continuation-in-part of application No. 12/039,608, filed on Feb. 28, 2008, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/178,467, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, and a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, application No. 12/178,467, which is a continuation-in-part of application No. 11/555,334, filed on Nov. 1, 2006, now Pat. No. 7,419,018.

(51) Int. Cl.
*E21B 10/26* (2006.01)
*E21B 10/60* (2006.01)

(52) U.S. Cl. ..... 175/389; 175/324; 175/393

(58) Field of Classification Search ..... 175/57, 175/324, 389, 393

See application file for complete search history.

(56) References Cited

U.S. PATENT DOCUMENTS

| | | | | |
|---|---|---|---|---|
| 2,735,653 | A * | 2/1956 | Bielstein | 91/40 |
| 3,105,560 | A * | 10/1963 | Zublin | 175/56 |
| 3,251,424 | A * | 5/1966 | Brooks | 175/56 |
| 6,089,332 | A * | 7/2000 | Barr et al. | 175/45 |

* cited by examiner

*Primary Examiner*—Hoang Dang
(74) *Attorney, Agent, or Firm*—Holme Roberts & Owen LLP

(57) ABSTRACT

In one aspect of the present invention a drill bit has a jack element with a distal end extending beyond a working face. A porting mechanism within the bore comprises first and second discs contacting along a flat interface. The first disc is attached to a turbine which is adapted to rotate the first disc with respect to the second disc. The discs comprise a first set of ports adapted to align and misalign with each other as the first disc rotates. The first set of ports is adapted to route a drilling fluid to extend the jack element.

16 Claims, 10 Drawing Sheets

104

DRILL BIT PORTING SYSTEM

CROSS REFERENCE TO RELATED APPLICATIONS

This Patent Application is a continuation-in-part of U.S. patent application Ser. No. 12/039,608 filed Feb. 28, 2008, which is a continuation-in-part of U.S. patent application Ser. No. 12/037,682 filed Feb. 26, 2008, now U.S. Pat. No. 7,624,824, which is a is a continuation-in-part of U.S. patent application Ser. No. 12/019,782 filed Jan. 25, 2008, now U.S. Pat. No. 7,617,886, which is a continuation-in-part of U.S. patent application Ser. No. 11/837,321 filed Aug. 10, 2007, now U.S. Pat. No. 7,559,379, which is a continuation-in-part of U.S. patent application Ser. No. 11/750,700 filed May 18, 2007, now U.S. Pat. No. 7,549,489. U.S. patent application Ser. No. 11/750,700 is a continuation-in-part of U.S. patent application Ser. No. 11/737,034 filed Apr. 18, 2007, now U.S. Pat. No. 7,503,405. U.S. patent application Ser. No. 11/737,034 is a continuation-in-part of U.S. patent application Ser. No. 11/686,638 filed Mar. 15, 2007, now U.S. Pat. No. 7,424,922. U.S. patent application Ser. No. 11/686,638 is a continuation-in-part of U.S. patent application Ser. No. 11/680,997 filed Mar. 1, 2007, now U.S. Pat. No. 7,419,016. U.S. patent application Ser. No. 11/680,997 is a continuation-in-part of U.S. patent application Ser. No. 11/673,872 filed Feb. 12, 2007, now U.S. Pat. No. 7,484,576. U.S. patent application Ser. No. 11/673,872 is a continuation-in-part of U.S. patent application Ser. No. 11/611,310 filed Dec. 15, 2006, now U.S. Pat. No. 7,600,586. This Patent Application is also a continuation-in-part of U.S. patent application Ser. No. 11/278,935 filed Apr. 6, 2006, now U.S. Pat. No. 7,426,968. U.S. patent application Ser. No. 11/278,935 is a continuation-in-part of U.S. patent application Ser. No. 11/277,394 filed Mar. 24, 2006 now U.S. Pat. No. 7,398,837. U.S. patent application Ser. No. 11/277,394 filed Mar. 24, 2006, now U.S. Pat. No. 7,398,837, is a continuation-in-part of U.S. patent application Ser. No. 11/277,380 filed Mar. 24, 2006, now U.S. Pat. No. 7,337,858. U.S. patent application Ser. No. 11/277,380 is a continuation-in-part of U.S. patent application Ser. No. 11/306,976 filed Jan. 18, 2006, now U.S. Pat. No. 7,360,610. U.S. patent application Ser. No. 11/306,976 is a continuation-in-part of Ser. No. 11/306,307 filed Dec. 22, 2005, now U.S. Pat. No. 7,225,886. U.S. patent application Ser. No. 11/306,307 is a continuation-in-part of U.S. patent application Ser. No. 11/306,022 filed Dec. 14, 2005, now U.S. Pat. No. 7,198,119. U.S. patent application Ser. No. 11/306,022 is a continuation-in-part of U.S. patent application Ser. No. 11/164,391 filed Nov. 21, 2005, now U.S. Pat. No. 7,270,196. This application is also a continuation-in-part of U.S. patent application Ser. No. 11/555,334, now U.S. Pat. No. 7,419,018, which was filed on Nov. 1, 2006. All of these applications are herein incorporated by reference in their entirety.

BACKGROUND OF THE INVENTION

This invention relates to the field of percussive tools used in drilling. More specifically, the invention includes a downhole jack hammer which may be actuated by the drilling fluid.

The prior art has addressed the operation of a downhole hammer actuated by drilling mud. Such operations have been addressed in the U.S. Pat. No. 7,073,610 to Susman, which is herein incorporated by reference for all that it contains. The '610 patent discloses a downhole tool for generating a longitudinal mechanical load. In one embodiment, a downhole hammer is disclosed which is activated by applying a load on the hammer and supplying pressurizing fluid to the hammer.

The hammer includes a shuttle valve and piston that are moveable between first and further position, seal faces of the shuttle valve and piston being released when the valve and the piston are in their respective further positions, to allow fluid flow through the tool. When the seal is releasing, the piston impacts a remainder of the tool to generate mechanical load. The mechanical load is cyclical by repeated movements of the shuttle valve and piston.

U.S. Pat. No. 6,994,175 to Egerstrom, which is herein incorporated by reference for all that it contains, discloses a hydraulic drill string device that can be in the form of a percussive hydraulic in-hole drilling machine that has a piston hammer with an axial through hole into which a tube extends. The tube forms a channel for flushing fluid from a spool valve and the tube wall contains channels with ports cooperating with the piston hammer for controlling the valve.

U.S. Pat. No. 4,819,745 to Walter, which is herein incorporated by reference for all that it contains, discloses a device placed in a drill string to provide a pulsating flow of the pressurized drilling fluid to the jets of the drill bit to enhance chip removal and provide a vibrating action in the drill bit itself thereby to provide a more efficient and effective drilling operation.

BRIEF SUMMARY OF THE INVENTION

In one aspect of the present invention a drill bit comprises a jack element substantially coaxial with an axis of rotation. The jack element comprises a distal end extending beyond a working face of the drill bit. A porting mechanism disposed within the bore comprises a first and second disc substantially contacting along a flat interface substantially normal to the axis of rotation. The first disc is attached to a turbine which is adapted to rotate the first disc with respect to the second disc. The discs comprise a first set of ports adapted to align and misalign with each other as the first disc rotates. The first set of ports is adapted to route a drilling fluid into the porting mechanism and to extend the jack element further beyond the working surface of the drill bit.

The discs may also comprise a second set of ports adapted to align and misalign with each other as the first disc rotates. The second set of ports may be adapted to route a drilling fluid to retract the jack element back towards the bore of the drill bit. When the jack element is retracted, the drilling fluid may pass through the first set of ports through an exhaust port of the first disc and out toward a formation.

In some embodiments, the drilling fluid extends the jack element through pushing on a piston which pushes on the jack element.

The jack element may be attached to a shaft adapted to rotate within a bore of the drill bit or a portion of a tool string attached to the drill bit. The jack element and shaft may be splined together. The jack element may be adapted to rotate and oscillate. The shaft may be in communication with at least one turbine disposed within the bore. The shaft may comprise a snap ring on a proximal and distal end that attaches to a lubricant reservoir and the second disc. The shaft may also comprise a spring on the proximal end that interacts with the snap ring. The shaft may further comprise a rotary cup seal between the turbine and stator. The first set of ports may comprise a larger total flow area than the second set of ports. The stator may be attached to the drill bit by at least one pin that may be press-fit into the shaft. The jack element may be attached to a tapered piston with a geometry to reduce the weight on the bit and direct fluid. The first disc may comprise at least one ball bearing within a chamber adapted to reduce friction. The at least one ball bearing may be a thrust bearing, a self-aligning bearing, roller thrust bearing, or a fluid film thrust bearing. The jack may comprise a bearing, a bushing, or a combination thereof. The drill bit may comprise a rotary cup seal adapted to rotate opposite each other. The drill bit may also comprise a lubrication system that extends from the distal end of the shaft to the proximal end. The second disc may comprise at least three ports of varying dimensions. The porting mechanism may be in communication with a telemetry system.

In another aspect of the invention, a method comprising the steps of providing a first disc attached to a turbine which is adapted to rotate the first disc with respect to the second disc. The method further comprises a step of rotating the first disc and the second disc relative to one another. Also, the method further comprises a step for allowing fluid to flow through a first set of ports and exhaust through a second set of ports as the first and second disc rotate.

DETAILED DESCRIPTION OF THE INVENTION AND THE PREFERRED EMBODIMENT

Figure 1:
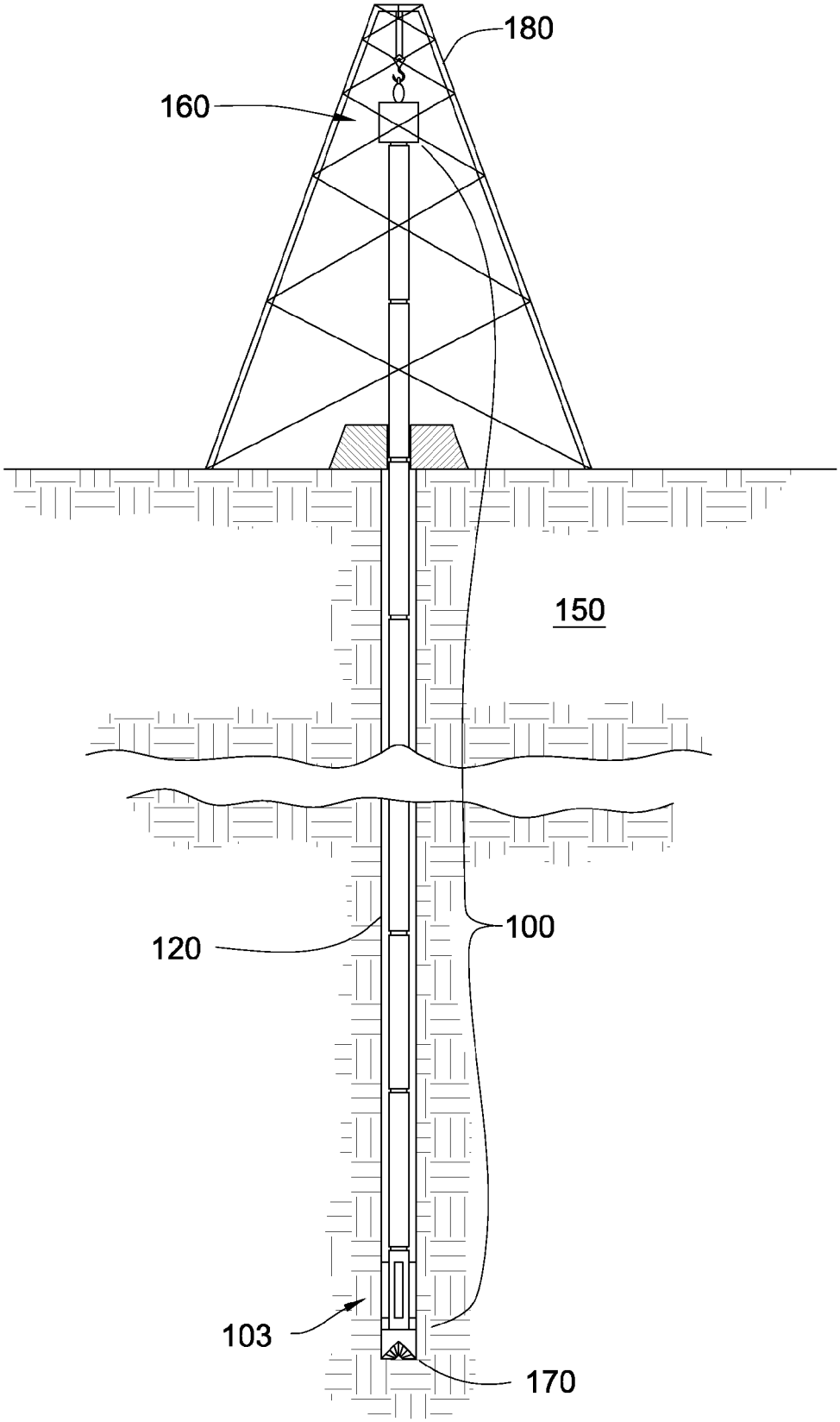
FIG. 1 is a perspective diagram of an embodiment of a tool string.

FIG. 1 is a perspective diagram of an embodiment of a tool string 100 suspended by a derrick 180 in a bore hole 102. A drilling assembly 103 is located at the bottom of the bore hole 120 and comprises a drill bit 170. As the drill bit 170 rotates downhole the tool string 100 advances farther into the earth. The drill string 100 may penetrate soft or hard subterranean formations 150. The drilling assembly 103 and/or downhole components may comprise data acquisition devices which may gather data. The data may be sent to the surface via a transmission system to a data swivel 160. The data swivel 160 may send the data to the surface equipment. Further, the surface equipment may send data and/or power to downhole tools and/or the drilling assembly 103. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, wired pipe, and/or short hop. In some embodiments, no telemetry system is incorporated into the tool string.

Figure 2:
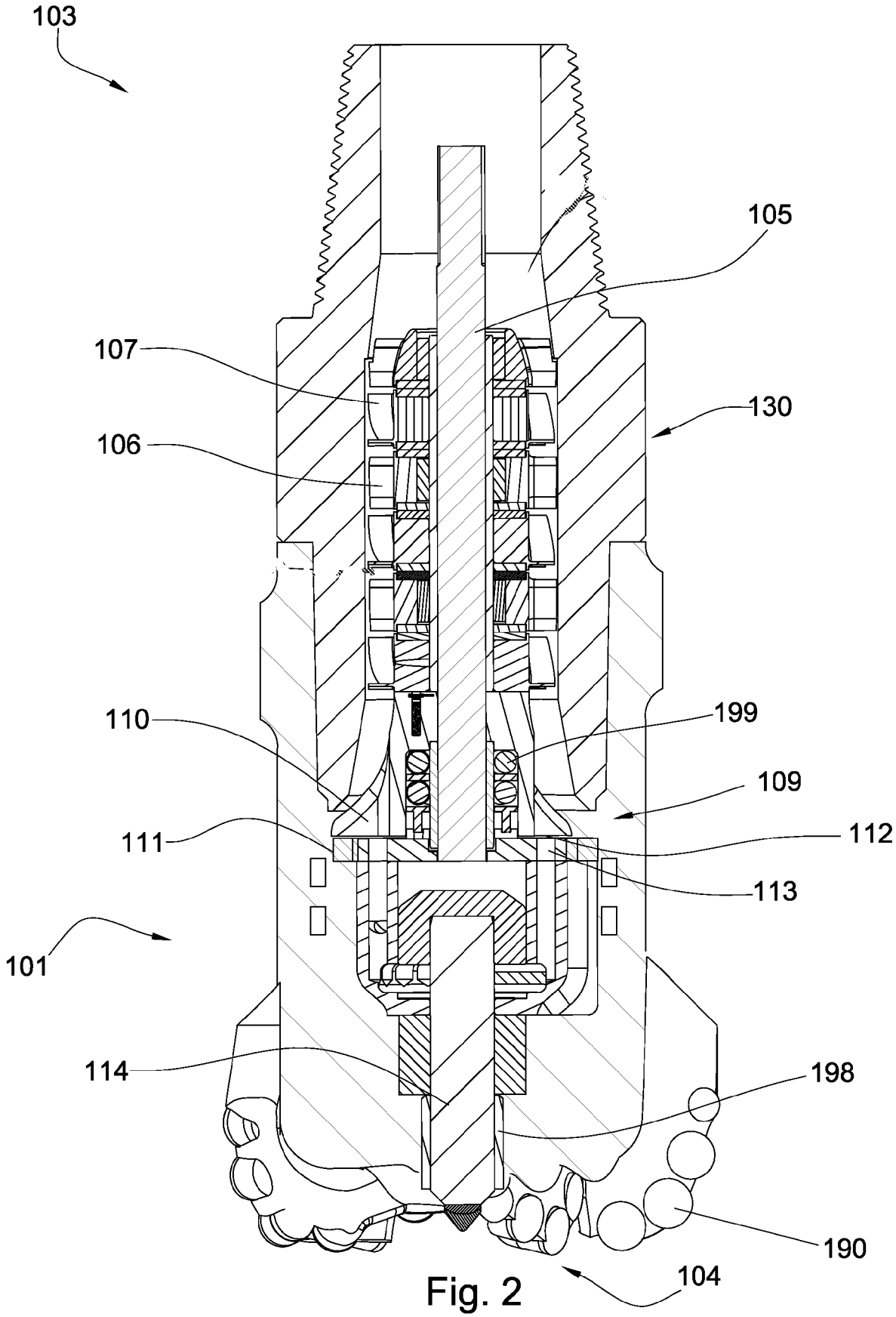
FIG. 2 is a cross-sectional diagram of an embodiment of a drilling assembly.

FIG. 2 is a cross-sectional diagram of an embodiment of a drilling assembly 103. The drilling assembly 103 may be attached to a shank 130. The drill bit 170 may comprise a working face 104 with a plurality of cutting elements 190 adapted to drill into a formation. The shank 130 of the drilling assembly 103 may comprise a shaft 105 that may rotate. The shaft 105 may be in communication with at least one stator 106 and at least one turbine 107. The shaft 105 may rotate from rotation of the turbine 170. The shank 130 may also comprise a lubricant reservoir adapted to deliver a lubricant throughout the drilling assembly 103. A lubricant path may run through the at least one stator 106 and turbine 107. The at least one stator 106 and turbine 107 may be adapted to allow a fluid such as drilling mud to flow through them and eventually out to a formation. The drilling assembly 103 may further comprise a porting mechanism 109 with a first 110 and second 111 disc that may be substantially contacting along a substantially flat interface substantially normal to an axis of rotation. The first disc 110 may be attached to the turbine 107 which may be adapted to rotate the first disc 110 with respect to the second disc 111. The first disc 110 comprises at least one ball bearing 199 within a chamber adapted to reduce friction. The at least one ball bearing 199 may be a thrust bearing, a self-aligning bearing, roller thrust bearing, or a fluid film thrust bearing. The jack element 114 may comprise a bushing 198. The first disc 110 may comprise a first set of ports 112 adapted to align and misalign with a first set of ports 113 of the second disc 111. The first set of ports 112 may be adapted to route a drilling fluid to a jack element 114 to extend it further beyond the working face 104 of the drill bit 170. The jack element 114 may comprise a diamond cutting element 190 adapted to cut through a formation.

Figure 3:
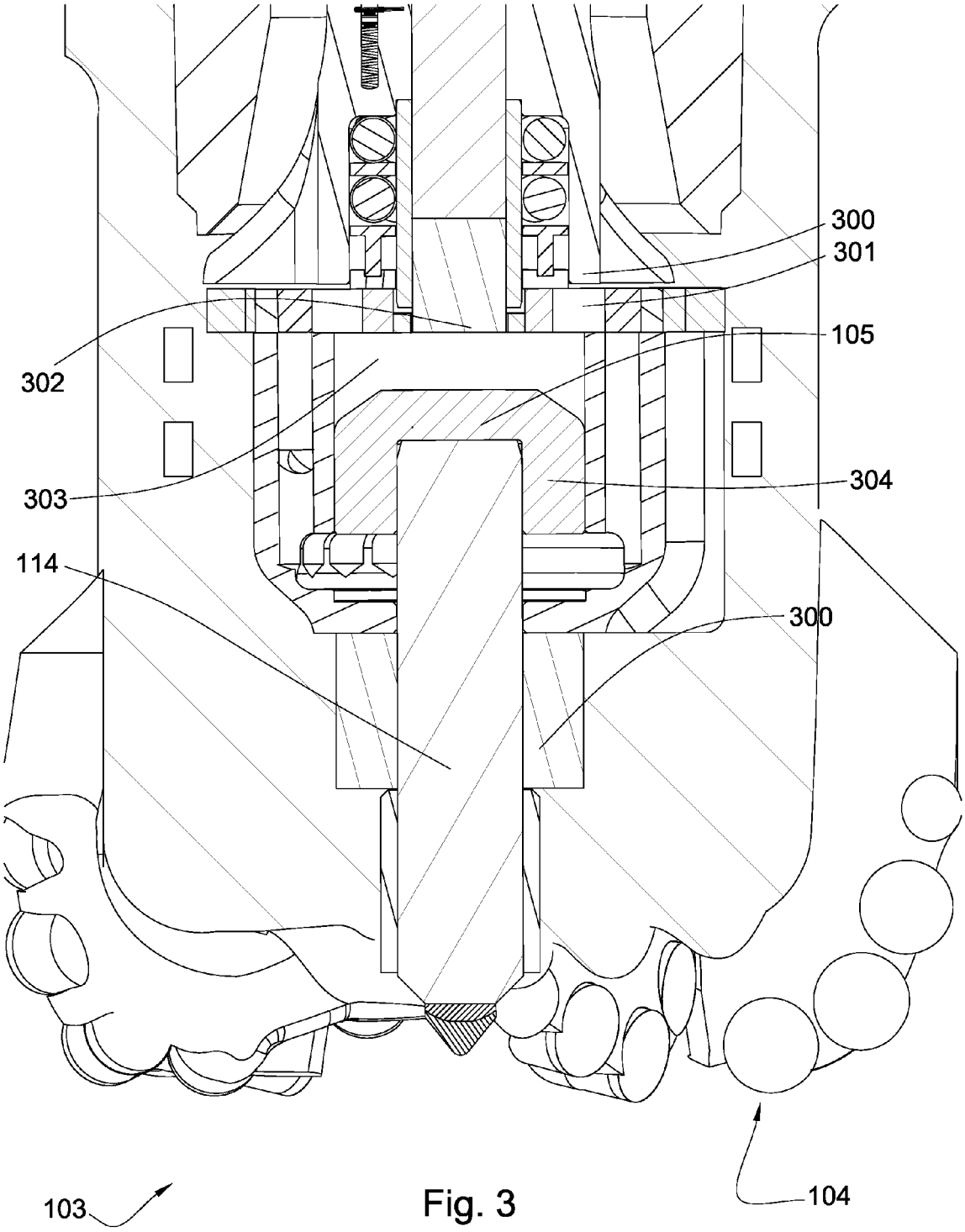
FIG. 3 is another cross-sectional diagram of an embodiment of a drilling assembly.

FIG. 3 discloses that the first disc 110 may also comprise a second set of ports 300 adapted to align and misalign with a second set of ports 301 of the second disc 111. The second set of ports may be adapted to route the fluid to protrude the jack element 114 towards the formation. When the jack element 114 is retracted, the drilling fluid that may pass through an exhaust port of the first disc 110 and out toward a formation. FIG. 2 shows the first set of ports of the first disc 110 aligned with the first set of ports of the second disc 111. This may allow the jack element 114 to retract from the working face 104. Such a mechanism may allow the jack element 114 to oscillate and rotate. It is believed that as the jack element 114 rotates and oscillate it may contribute to weakening the formation reducing the load on the cutting elements.

FIG. 3 also discloses the second set of ports 300 of the first disc 110 aligned with the second set of ports 301 of the second disc 111. This may allow the jack element 114 to protrude from the working face 104 because the fluid may push on a distal end 303 of a tapered piston 304 in communication with the jack element 114. The jack element 114 may be in communication with the shaft 105 by a splined mechanism 302. It is believed that by attaching the shaft 105 to the jack element 114 the rotation of the shaft 105 may rotate the jack element 114.

Figure 4:
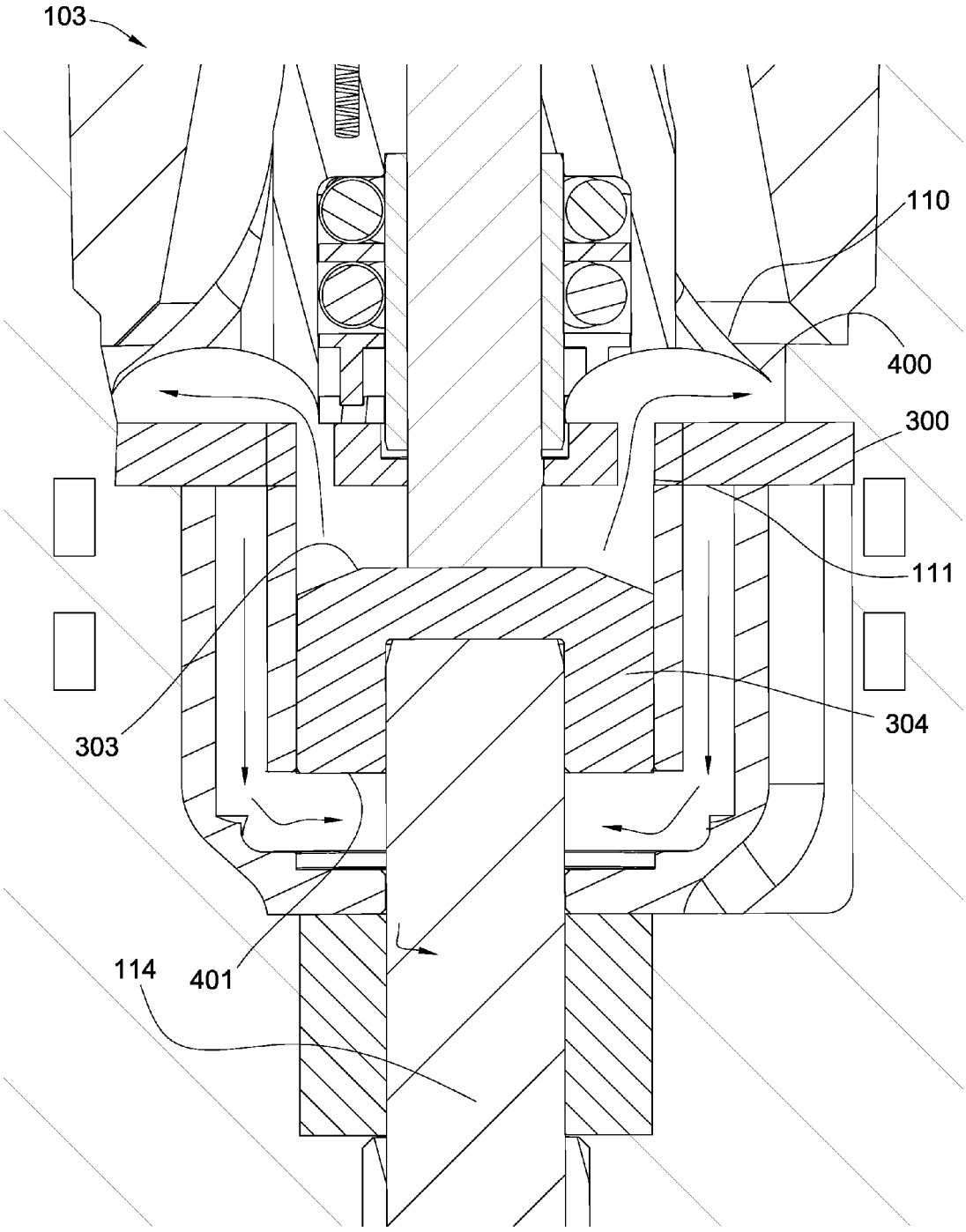
FIG. 4 is another cross-sectional diagram of an embodiment of a drilling assembly.

Now referring to FIG. 4 the second disc 111 may rotate and align its first ports such that fluid may enter and contact the jack element 114 at a proximal end 401 forcing it to retract from the working face 104. When the jack element 114 retracts from fluid contacting the proximal end 401 of the piston 304 fluid contacting the distal end 303 of the piston may exit through at least one exhaust port 400 of the first disc 110. The exhaust port 400 may be disposed in the first disc 110 on its outer diameter. Such an arrangement may allow for fluid to pass through other ports as other fluid passes through the exhaust port 400. The exhaust port 400 may also comprise a concave geometry that may allow for more fluid to flow through the exhaust ports 400.

Figure 5:
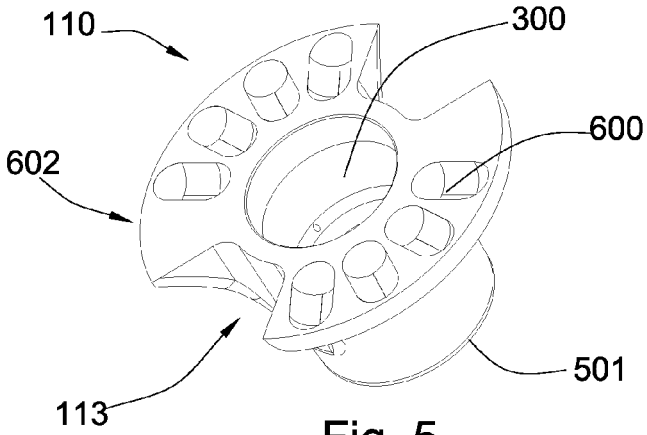
FIG. 5 is a perspective diagram of an embodiment of a first disc.

FIG. 5 discloses a first disc 110 comprising a first 113 and second 300 set of ports adapted to align and misalign with ports of the second disc. The first disc 110 may also comprise at least one exhaust port 600. The first disc 110 may comprise distal end with a diameter smaller than the diameter of the proximal end.

Figure 6:
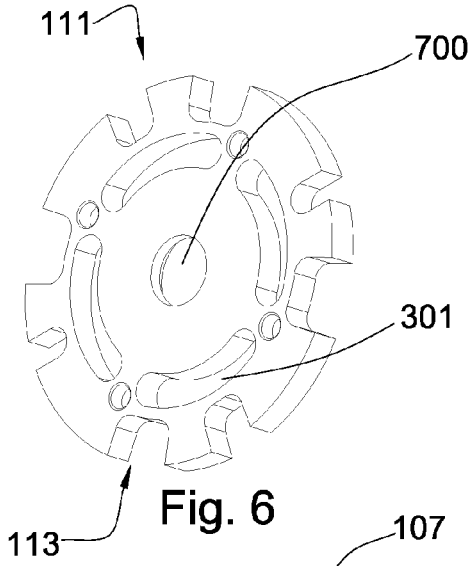
FIG. 6 is a perspective diagram of an embodiment of a second disc.

FIG. 6 discloses a second disc 111 comprising a first 113 and second 301 set of ports adapted to align and misalign with ports of the first disc. The first set of ports 113 of the second disc 111 may comprise a smaller length than that of the second set of ports. The second disc 111 may also comprise a central exhaust passage 700.

Figure 7:
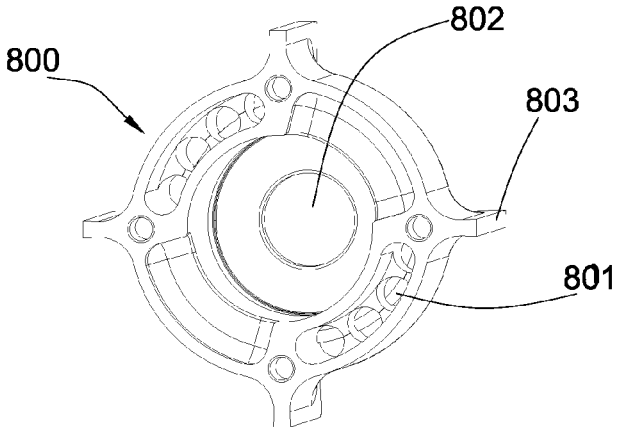
FIG. 7 is a perspective diagram of an embodiment of a valve.

FIG. 7 discloses a valve 800 comprising at least one port 801 that may be lead to the tapered piston in communication with the jack element 114. The valve 800 may comprise a central port 802 that may allow fluid to pass through. The valve 800 may also comprise stabilizers 803.

Figure 8:
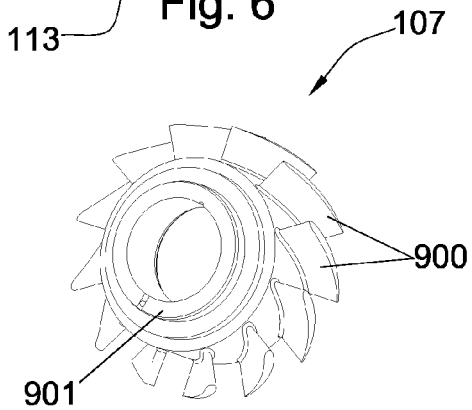
FIG. 8 is a perspective diagram of an embodiment of a turbine.

FIG. 8 discloses a turbine 107 comprising a plurality of curved fins 900 about its center axis. The turbine 107 may comprise a body 901 adapted to attach to a stator and fit around the shaft. The turbine 107 may be threaded to the stator 106, or fit into the stator 106.

Figure 9:
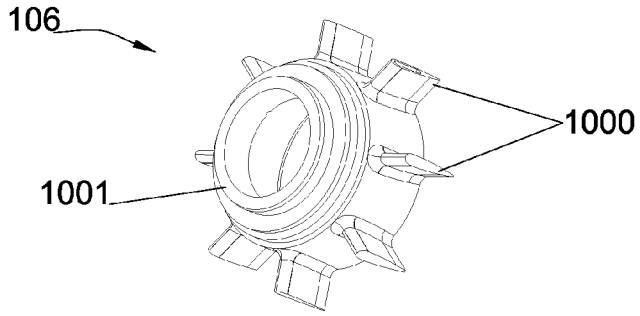
FIG. 9 is a perspective diagram of an embodiment of a stator.

FIG. 9 discloses a stator 106 comprising a plurality of fins 1000 that may be parallel to its central axis. The stator 106 may also comprise a body portion 1001 adapted to attach to the turbine and fit around the shaft.

Figure 10:
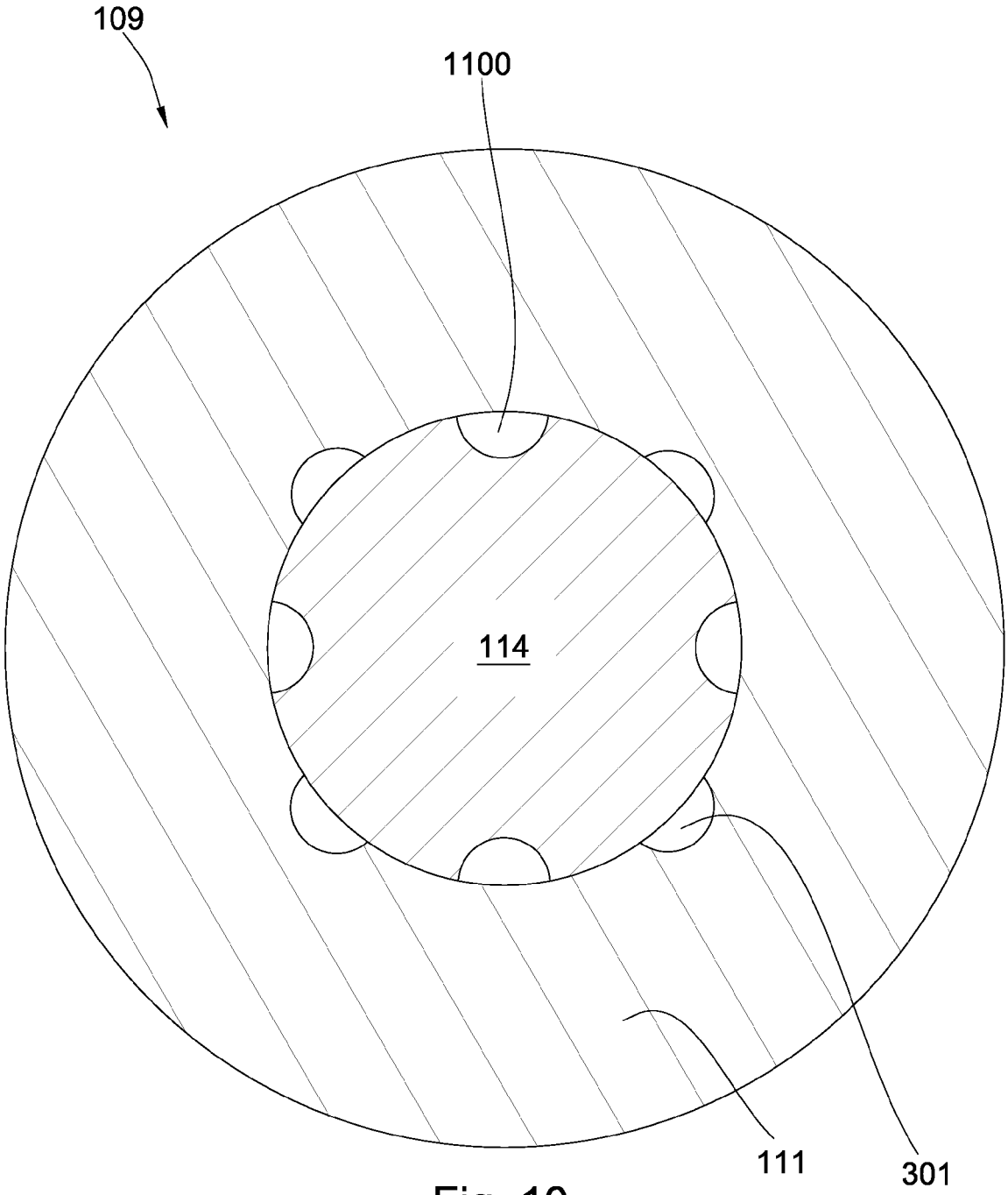
FIG. 10 is a top view diagram of an embodiment of a porting mechanism.

FIG. 10 is a top view diagram of an embodiment of a porting mechanism 109. The drilling assembly 103 may comprise a jack element 114 with passages 1100. The second set of ports 301 of the second disc 111 may align with the passages 1100. Fluid may pass through the ports and the passages to contact the jack element 114 and/or piston 304. This may cause the jack element 114 to extend out into a formation.

Figure 11:
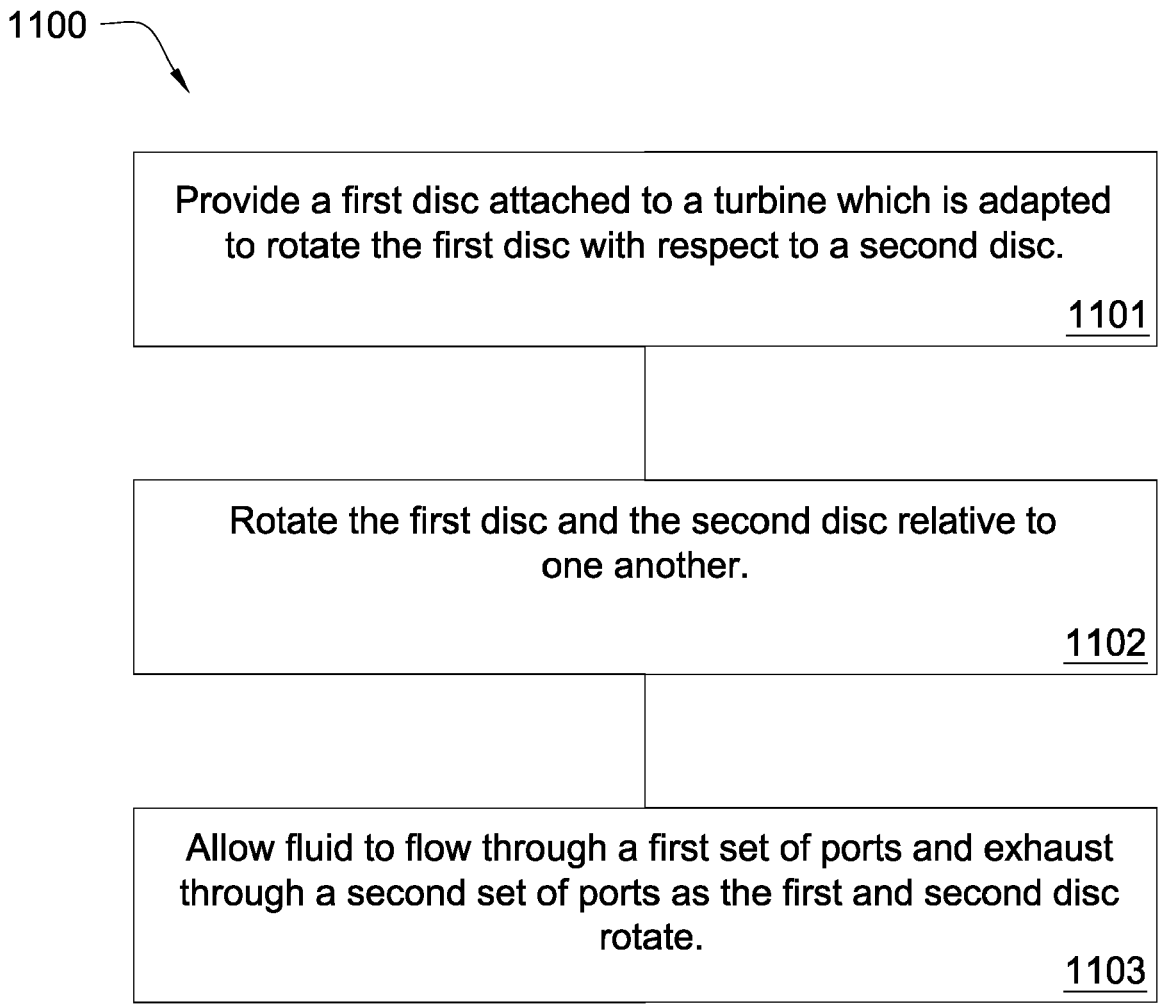
FIG. 11 is flowchart of an embodiment of a method of porting.

FIG. 11 is flowchart illustrating an embodiment of a method of porting. The method comprises a step 1101 of providing a first disc attached to a turbine which is adapted to rotate the first disc with respect to a second disc. The method also comprises a step 1102 of rotating the first disc and the second disc relative to one another. Further more the method comprises a step 1103 of allowing fluid to flow through a first set of ports and exhaust through a second set of ports as the first and second disc rotate.

Figure 12:
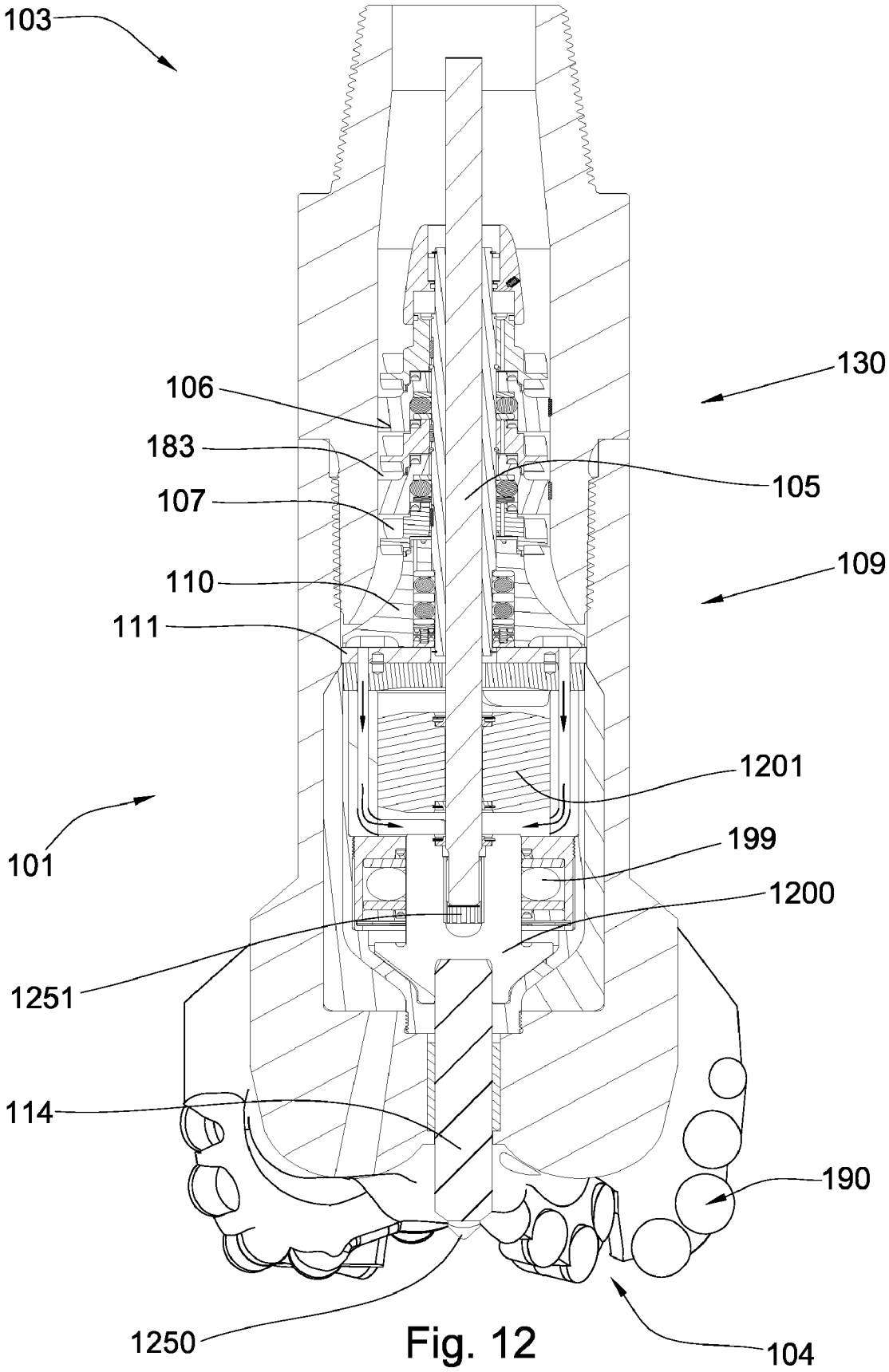
FIG. 12 is a cross-sectional diagram of an embodiment of a porting system.
Figure 13:
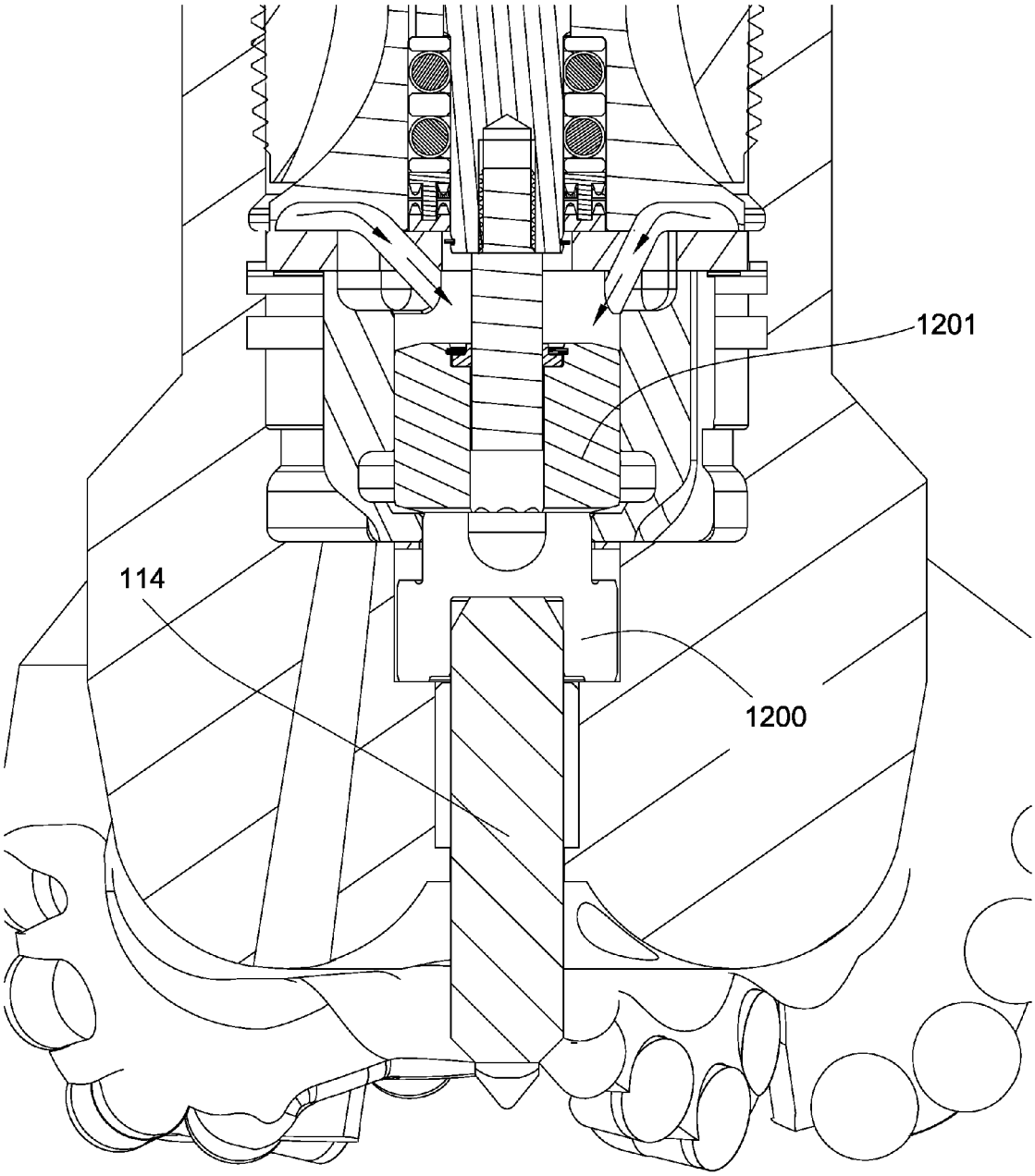
FIG. 13 is cross-sectional diagram of an embodiment of a porting system.

FIG. 12 discloses a porting system 109 in communication with a piston 1201. The piston 1201 may intermittently contact a base 1200 of the jack element 114. FIG. 12 depicts the piston 1201 retracting from the base 1200 of the jack element 114 by a fluid passing through the porting mechanism 109. FIG. 13 discloses the porting system 109 pushing the piston 1201 into contact with the base 1200 of the jack element 114. It is believed that a piston 1201 that intermittently contacts the base 1200 of the jack element 114 may aid in penetrating and degrading a formation. The base 1200 of the jack element 114 may be in communication with bearings 199 to reduce friction. The shaft 105 may also be in communication with the base 1200 of the jack element 114. The shaft 105 may comprise grooves adapted to communication with a gear 1251 of the base 1200. It is believed that such an arrangement may aid in steering the drilling assembly 103. The jack element 114 may comprise a pointed or a biased tip 1250 to aid in steering and penetration.

Figure 14:
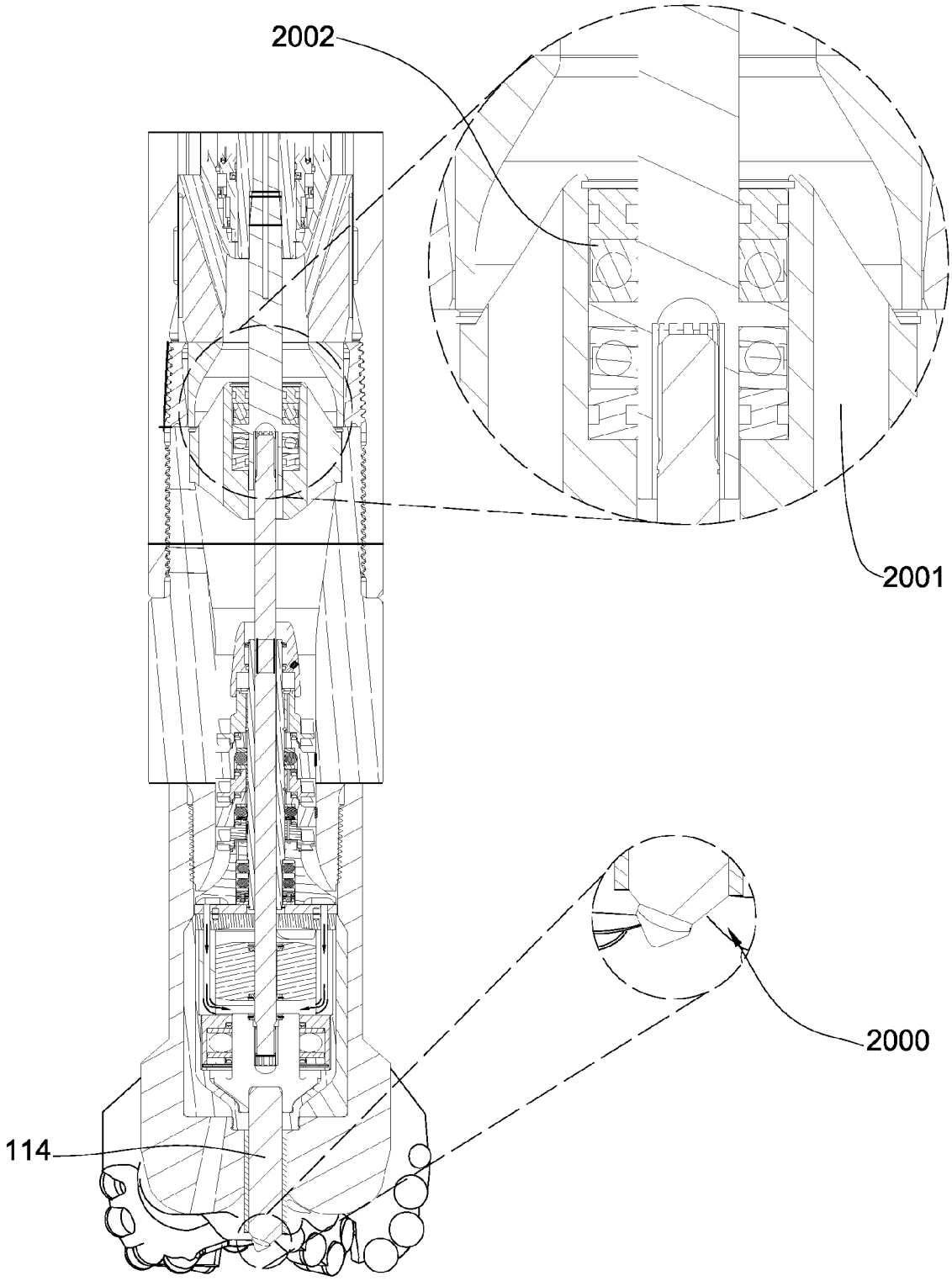
FIG. 14 is a cross-sectional diagram of an embodiment of a drilling assembly.

FIG. 14 discloses a drilling system that is adapted to hammer and steer the drill bit. The distal end of the jack element 114 comprises a canted insert 2000 adapted to steer the bit. A spider 2001 is inserted above the turbine and adapted to take up a side load induced from steering. A radial bearing 2002 is incorporated in the spider to accommodate rotation of the shaft.

Whereas the present invention has been described in particular elation to the drawings attached hereto, it should be understood that other and further modifications apart from those shown or suggested herein, may be made within the scope and spirit of the present invention.

What is claimed is:

1. A drill bit, comprising;

a jack element substantially coaxial with an axis of rotation of the drill bit, the jack element comprises a distal end extending beyond a working face of the drill bit;

a porting mechanism disposed within the bore comprising a first and second disc substantially contacting along a flat interface substantially normal to the axis of rotation;

the first disc attached to a turbine which is adapted to rotate the first disc with respect to the second disc; and the discs comprise a second set of ports adapted to align and misalign with each other as the first disc rotates, the second set of ports being adapted to route a drilling fluid into the porting mechanism and to extend the jack element further beyond the working surface of the drill bit;

wherein the jack element is attached to a shaft adapted to rotate.

2. The drill bit of claim 1, wherein the drilling fluid extends the jack element through pushing on a piston which pushes on the jack element.

3. The drill bit of claim 1, wherein the discs also comprise a first set of ports adapted to align and misalign with each other as the first disc rotates, the first set of ports being adapted to route a drilling fluid to retract the jack element back towards the bore of the drill bit; and wherein, when the jack element is retracted the drilling fluid that passes through the first set of ports passes through an exhaust port of the first disc and out toward a formation.

4. The drill bit of claim 1, wherein the jack element comprises an attachment from the shaft to the jack element that is splined.

5. The drill bit of claim 4, wherein the jack element is adapted to rotate and oscillate by the rotation of the shaft.

6. The drill bit of claim 4, wherein the shaft is in communication with at least one turbine disposed within the bore.

7. The drill bit of claim 1, wherein the first set of ports comprises a larger total flow area than the second set of ports.

8. The drill bit of claim 1, wherein the turbine is attached to at least one stator.

9. The drill bit of claim 8, wherein the shaft comprises a rotary cup seal between the turbine and stator.

10. The drill bit of claim 8, wherein the stator is attached to the drill bit by at least one pin that is press-fit into the shaft.

11. The drill bit of claim 1, wherein the drill bit comprise a rotary cup seal adapted to rotate opposite each another.

12. The drill bit of claim 1, wherein the jack element is attached to a tapered piston with a geometry to reduce weight and direct fluid.

13. The drill bit of claim 1, wherein the first disc comprises at least one ball bearing within a chamber adapted to reduce friction.

14. The drill bit of claim 13, wherein the at least one ball bearing is a thrust bearing, a self-aligning roller thrust bearing, or a fluid film thrust bearing.

15. The drill bit of claim 1, wherein the jack element comprises a bearing, a bushing, or a combination thereof.

16. The drill bit of claim 1, wherein the porting mechanism is in communication with a telemetry system.

* * * * *